US006046577A

United States Patent [19]

Rincon-Mora et al.

[11] Patent Number: 6,046,577

[45] Date of Patent: Apr. 4, 2000

[54] LOW-DROPOUT VOLTAGE REGULATOR INCORPORATING A CURRENT EFFICIENT TRANSIENT RESPONSE BOOST CIRCUIT

[75] Inventors: Gabriel A. Rincon-Mora, Margate, Fla.; Nicolas Salamina, Sachse, Tex.

[73] Assignee: Texas Instruments Incorporated, Dallas, Tex.

[21] Appl. No.: 09/001,057

[22] Filed: Dec. 30, 1997

Related U.S. Application Data

[60] Provisional application No. 60/035,726, Jan. 2, 1997.

[51] Int. Cl.[7] ..... G05F 1/40

[52] U.S. Cl. ..... 323/282; 323/279; 323/280; 323/281

[58] Field of Search ..... 323/282, 280, 323/281, 276, 279

[56] References Cited

U.S. PATENT DOCUMENTS 4,008,418 2/1977 Murphy ..... 323/276

5,130,635 7/1992 Kase ..... 323/280

5,686,820 11/1997 Riggio, Jr. ..... 323/273

*Primary Examiner*—Peter S. Wong

*Assistant Examiner*—Rajnikant D. Patel

*Attorney, Agent, or Firm*—Mark E. Courtney; W. James Brady III; Richardson L. Donaldson

[57] ABSTRACT

An improved low-dropout ("LDO") voltage regulator incorporates a transient response boost circuit which is added to the slew-rate limited node at the control terminal of the LDO voltage regulator output transistor and provides improved transient response performance to the application of various load current step stimuli while requiring no standby or quiescent current during zero output current load conditions. The transient boost circuit supplies current to the slew-rate limited node only upon demand and may be constructed as either a localized positive feedback loop or a number of switching devices which conduct current only during slew-rate conditions.

32 Claims, 3 Drawing Sheets

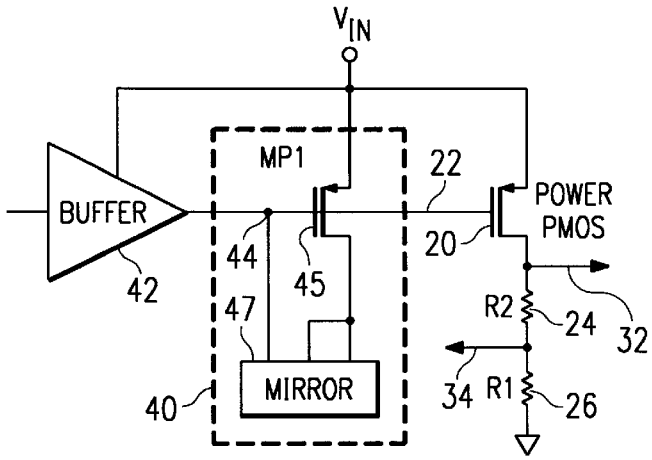
FIG. 5A
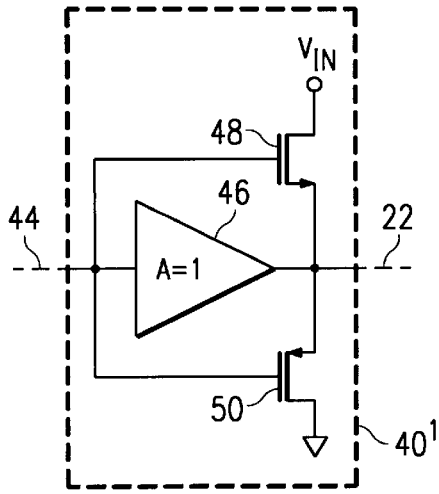
FIG. 5B
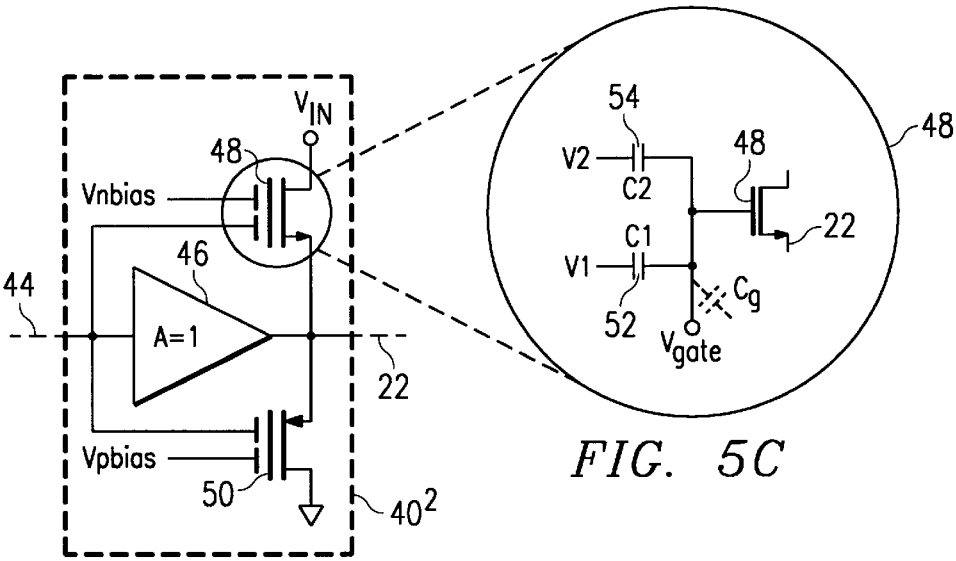
FIG. 5C
FIG. 6
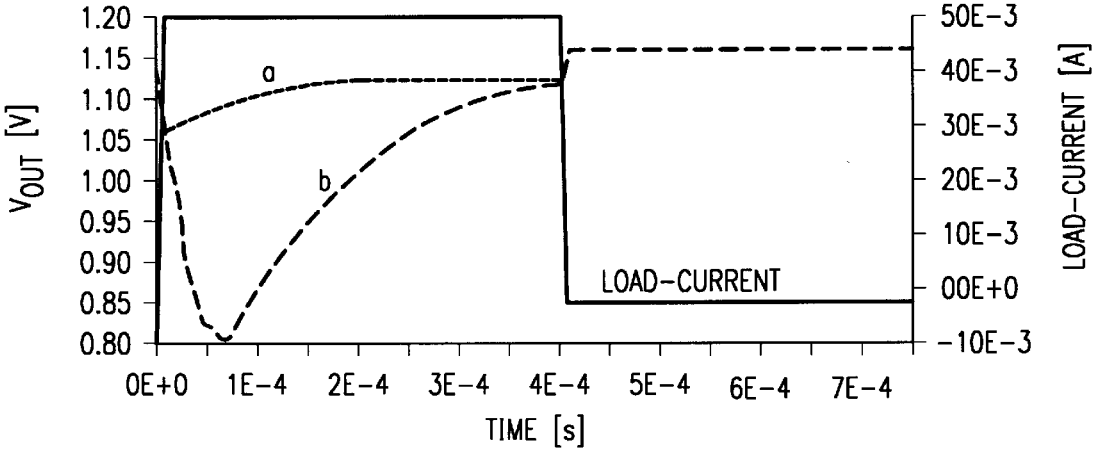

LOW-DROPOUT VOLTAGE REGULATOR INCORPORATING A CURRENT EFFICIENT TRANSIENT RESPONSE BOOST CIRCUIT

This application claims priority under 35 USC § 119(e) (1) of provisional application No. 60/035,726 filed Jan. 2, 1997.

BACKGROUND OF THE INVENTION

The present invention relates, ir general, to the field of integrated circuit semiconductor technology low-dropout ("LDO") voltage regulators. More particularly, the present invention relates to a current efficient LDO voltage regulator incorporating a transient response boost circuit which may be added to selectively apply current to a slew-rate limited node and yet requires no standby current during zero output current load conditions of the LDO voltage regulator.

Low-dropout voltage regulators are typically integrated circuits designed to provide generally fixed output voltages over varying loads with minimal voltage dropout over a relatively wide operating temperature range. They are oftentimes intended for use in portable, battery powered applications such as laptop computers, pagers cellular phones and the like. As a consequence, standby and quiescent current flow are major concerns in their design and some LDO voltage regulators incorporate a separate enable terminal to switch the device into a standby mode of operation to minimize power consumption when the associated device is disabled.

It has been observed that the transient response of an LDO voltage regulator to a full range load current step exhibits an output voltage "glitch". In a low quiescent current operational environment, the characteristics of this glitch are observed to be dominated by a slew-rate limited node defined by the relatively large gate terminal of the LDO voltage regulator series-connected power pass transistor, which, in certain applications, is generally a P-type metal oxide semiconductor ("PMOS") field effect transistor ("FET").

It is known that this undesired effect may be at least somewhat offset by adding more current to this node so as to charge and to discharge the associated capacitance of the gate. However, such a technique is generally not feasible in those typical applications in which low quiescent current flow is either necessary or desired due to the fact that the current boost to the slew-rate limited node of the LDO voltage regulator is not limited solely to "on demand" conditions. As a consequence, known techniques result in circuit designs that either necessitate the toleration of relatively large output glitch specifications or those that require more quiescent current flow than is desired during zero load current conditions.

It has also been observed that the AC requirements of the system are dependent on the load current and that typical implementations provide bias for "worst case" conditions. As a result, the quiescent current is not efficiently utilized and more quiescent current than is necessary may be used under certain conditions.

SUMMARY OF THE INVENTION

The present invention advantageously provides an improved LDO voltage regulator incorporating a novel transient response boost circuit of particular utility in overcoming the disadvantages inherent in prior devices and techniques. The circuit and method of the present invention is straightforward in design and inexpensively implemented in a current efficient design which provides improved transient response to the application of various load current step stimuli.

In a preferred embodiment disclosed herein, a transient boost circuit is added to the slew-rate limited node and requires no standby current during zero output current load conditions. Alternative embodiments of the transient boost circuit are disclosed which supply current to the slew-rate limited node only upon demand. A first embodiment may be realized utilizing a localized positive feedback loop while a second may be formed of a number of switching devices which conduct current only during slew-rate conditions. The circuit and method of the present invention may be constructed utilizing conventional semiconductor processing technologies including, inter alia, complementary metal oxide semiconductor ("CMOS"), bipolar complementary metal oxide semiconductor ("BiCMOS") and other standard discrete and integrated circuit processes.

Specifically disclosed herein is a low-dropout voltage regulator which comprises an error amplifier having first and second inputs and a reference output with the first input receiving an output of a bandgap circuit. An output switching device of the LDO voltage regulator includes first and second terminals and a control input with the first terminal being coupled to a first supply voltage input and the control input being coupled to receive a reference signal from the reference output of the error amplifier. First and second series coupled resistors couple the second terminal of the output switching device to a second supply voltage input while the second terminal of the output switching device is coupled to provide a voltage output of the LDO voltage regulator. A node intermediate the first and second resistors is coupled to the second input of the error amplifier. A transient boost circuit couples the reference output of the error amplifier to the control input of the output switching device and is operative to supply current to the control terminal of the output switching device in response to a current load placed on the voltage output of the LDO voltage regulator.

BRIEF DESCRIPTION OF THE DRAWINGS

The aforementioned and other features and objects of the present invention and the manner of attaining them will become more apparent and the invention itself will be best understood by reference to the following description of a preferred embodiment taken in conjunction with the accompanying drawings, wherein:

FIG. 5A is a more generalized functional representation of the output section of the LDO voltage regulator of FIG. 3 illustrating the particular embodiment of a transient boost circuit shown therein;

FIG. 5B is an additional generalized functional representation of the output section of the LDO voltage regulator of FIG. 3 illustrating an additional embodiment of a transient boost circuit in accordance with the present invention in the form of a number of switching devices which conduct current only during slew-rate conditions;

FIG. 5C is a more detailed schematic illustration of a variation of the transient boost circuit of FIG. 4B in accordance with a more specific embodiment of the present invention including an inset, detailed view of the particular switching devices; and FIG. 6 is a graphical representation of the output voltage ("$V_{out}$") of an LDO voltage regulator in accordance with the present invention taken over time in response to a step in the output current load ("$I_{Load}$") compared with that of a conventional LDO voltage regulator under similarly biased conditions.

DESCRIPTION OF A PREFERRED EMBODIMENT

Figure 1:
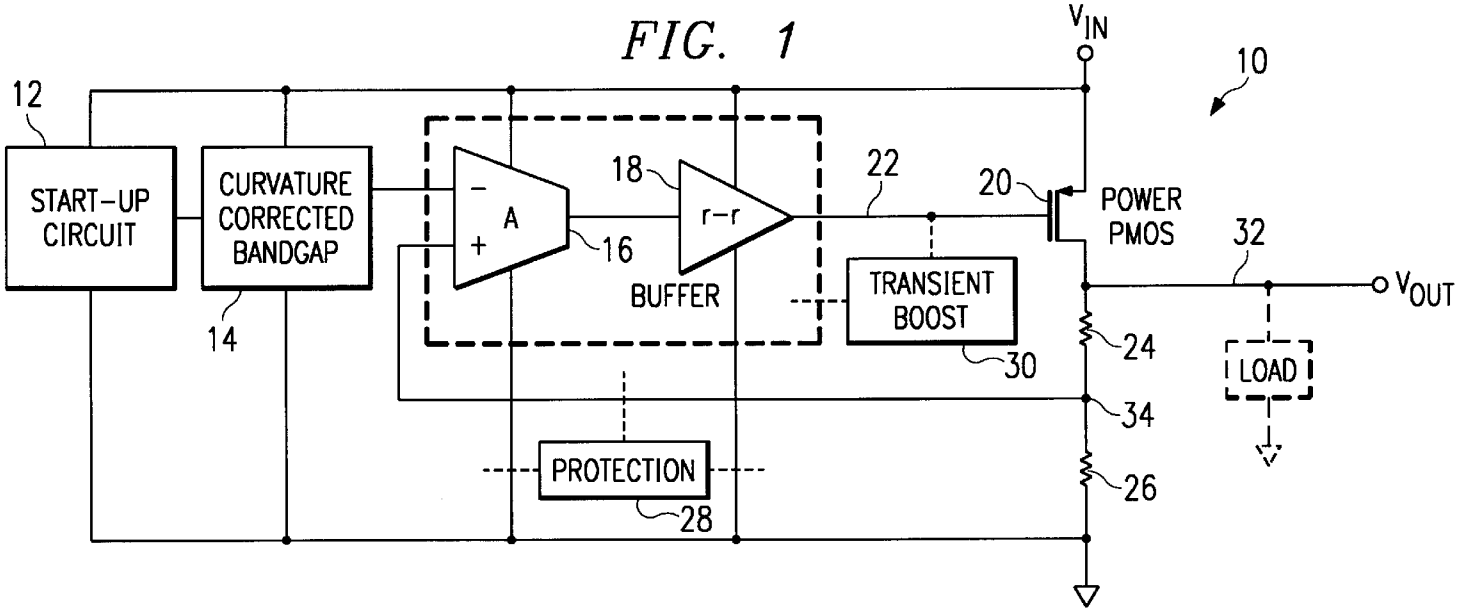
FIG. 1 is a simplified logical block diagram of the overall system architecture of an integrated circuit ("IC") low-dropout voltage regulator in accordance with the present invention incorporating a transient boost circuit as disclosed herein.

With reference now to FIG. 1, the overall system topology of an LDO voltage regulator 10 in accordance with the present invention is shown. The regulator 10 comprises, in pertinent part a start-up circuit 12 which may, in a particular embodiment comprise an external enabling input to a logic block within the regulator 10 coupled between an input voltage ("$V_{in}$") and circuit ground supply rails as shown.

A curvature corrected bandgap circuit 14 is also coupled between the voltage supply rails and may be operatively monitored by the start-up circuit 12 as shown. The bandgap circuit 14 is coupled to one input of an error amplifier 16 to provide a reference signal thereto, the error amplifier 16 also receiving operational power from the voltage supply rails, or sources. The error amplifier 16 has an error output for providing an error signal through a similarly powered rail-to-rail buffer 18 to supply a gate drive voltage to the control terminal of an output switching device comprising, in the embodiment shown, an output transistor 20. In the particular embodiment illustrated, the output transistor 20 comprises a power PMOS device having a drain terminal thereof coupled to the $V_{in}$ voltage supply source and a gate (or control) terminal thereof coupled to node 22.

Series connected resistors 24 and 26 couple the source terminal of transistor 20 to the ground supply voltage source as shown. A protection circuit 28 forms a portion of the voltage regulator 10 to provide, for example, overvoltage protection and thermal shutdown functions for the device. The foregoing elements define the basic functional components of a conventional LDO voltage regulator.

Further, and as will be more fully described hereinafter, the voltage regulator 10 of the present invention incorporates a transient boost circuit 30 coupled to the slew-rate limited node 22 at the gate of transistor 20. Voltage output ("$V_{out}$") from the voltage regulator 10 is taken at node 32 at the source of transistor 20 while a node 34 intermediate resistors 24, 26 is coupled back to a second feedback input of the error amplifier 16.

In operation, the gate terminal of the power PMOS transistor 20, coupled to node 22, is highly capacitive and the transient boost circuit 30 is of especial utility in those applications where the voltage regulator 10 must be operated in a relatively low quiescent current environment coupled with the necessity of stringent transient response performance. The problem of handling a full-range transient stimulus due to a current load at the output node 32 is proportional to the slew-rate current required to drive the gate of the power PMOS transistor 20 at node 22. In the past, this problem may have been resolved by providing a relatively high quiescent current flow to the node 22. However, such a technique is generally incompatible with low current design goals.

Figure 2:
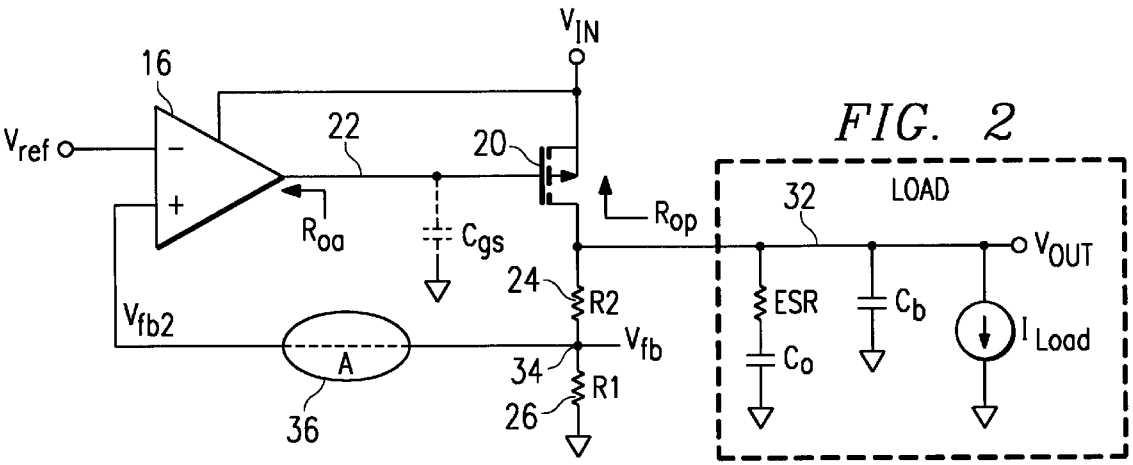
FIG. 2 is a partial, simplified schematic illustration of selected portions of the output section of a conventional LDO voltage regulator for purposes 2.

With reference additionally now to FIG. 2, the topology of a conventional LDO voltage regulator is illustrated for purposes of undertaking an AC analysis of the open-loop system. The AC response of the open-loop system (that is, opening the loop at point 36 "A") is described by the following equations:

| | |
|---|---|
| $P1 \approx 1/2\pi C_o r_{sd}$ | Equation 1 |
| $Z1 \approx 1/2\pi C_o ESR_{Co}$ | Equation 2 |
| $P2 \approx 1/2\pi C_b ESR_{Co}$ | Equation 3 |
| $P3 \approx 1/2\pi C_{gs} R_{oa}$ | Equation 4 |

where P3 constitutes the parasitic pole, $C_{gs}$ is the gate-to-source capacitance of node 22, ESR is the electrical (equivalent) series resistance of capacitance $C_o$, $C_b$ is the capacitance of the bypass capacitors and $I_{Load}$ is the load current. For the system to be stable with a phase margin of $\geqq 45°$, P3 must be greater than or equal to the unity gain frequency ("UGF").

Figure 3:
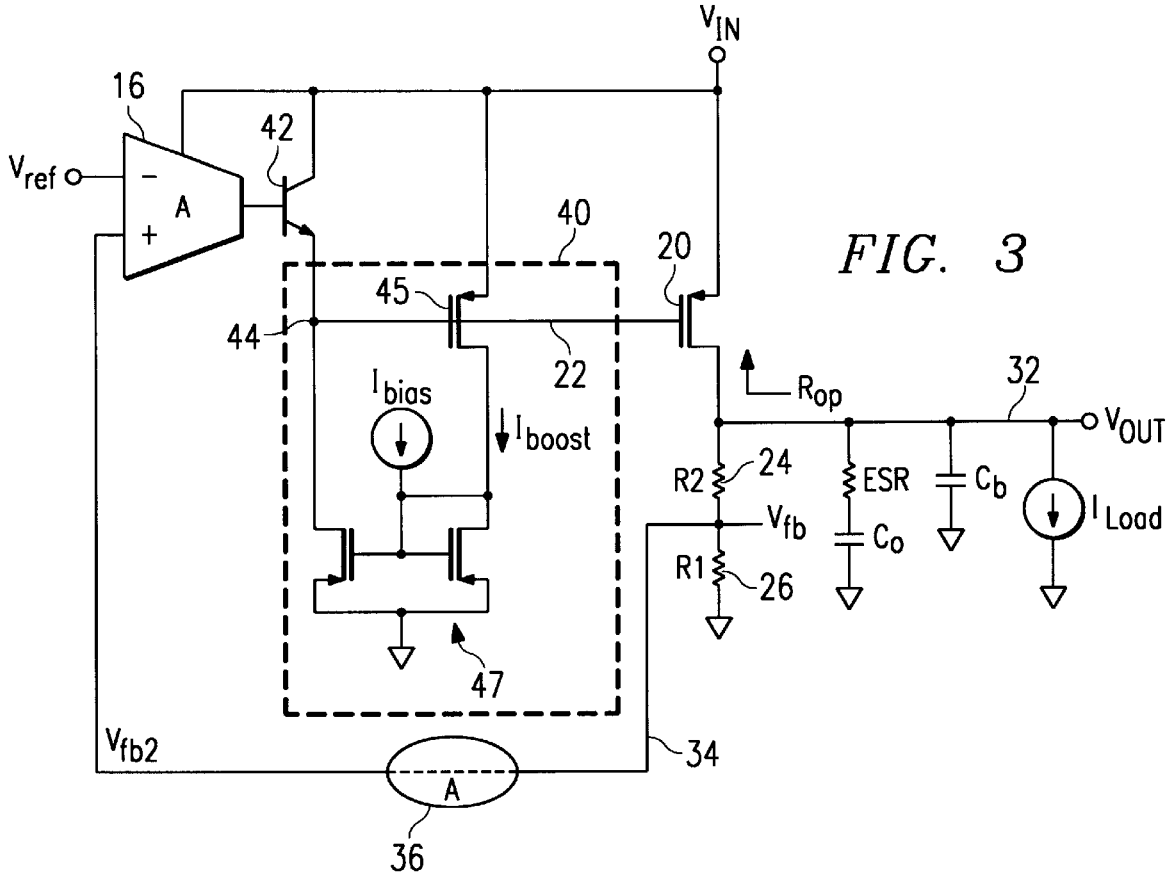
FIG. 3 is a partial, simplified schematic illustration of the output section of an LDO voltage regulator in accordance with the present invention including one particular embodiment of a transient boost circuit in the form of a localized positive feedback loop utilizing a single PMOS device and a current mirror as disclosed herein for purposes of comparison of the AC response of the open-loop system to the design of FIG. 2.

With reference additionally now to FIG. 3 the system of FIG. 2 is shown implemented in conjunction with a particular embodiment of a transient boost circuit 40 in accordance with the present invention. As shown, the equivalent error amplifier 16 is realized by means of an operational transconductance amplifier ("OTA") in conjunction with a buffer 42 comprising an emitter follower connected NPN type bipolar transistor 42 having its emitter terminal coupled to node 44 at the input of the transient boost circuit 40. In this particular embodiment, node 44 is connected in common with node 22 at the gate of transistor 20.

Figure 4:
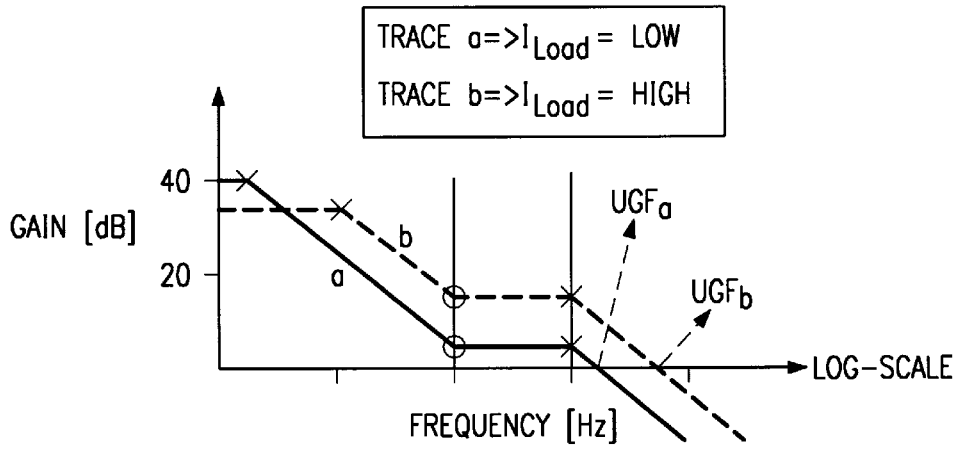
FIG. 4 is a graphical representation of the system frequency response as a function of load-current under both relatively high and low load-currents.

With respect additionally now to FIG. 4, at $I_{Load}$=0 Amps, P1 is low thereby making the unity gain frequency low. The parasitic pole P3 must only be greater than UGF[$I_{Load}$=0 A] which condition can be effectuated with approximately 1 $\mu$A. At this point, $I_{boost}$ is zero because the aspect ratio of the PMOS transistor 45 forming a portion of the transient boost circuit 40 is much less than that of the output PMOS transistor 20, thus yielding low quiescent current.

At $I_{Load}$=$I_{Load\text{-}max}$, P1 is moved up to higher frequencies making the unity gain frequency large. The parasitic pole P3 must then be moved up. This is accomplished by means of the transient boost circuit 40 since $I_{boost}$ (through one leg of a current mirror 47) can now be on the order of tens of $\mu$Amps. If the transient boost circuit 40 were not present, the minimum $I_{bias}$ and $I_{quiescent}$ would have been greater, determined at $I_{Load\text{-}max}$. In other words, the zero load quiescent current flow is lower for an LDO voltage regulator 10 using a transient boost circuit 40 than for an equivalent one without the boost. In operation, the transient boost circuit 40 effectively accomplishes load dependent biasing, thereby achieving a current efficient stable circuit design.

As described with respect to the preceding FIG. 3, a cost-efficient transient boost circuit 40 can be added to a conventional LDO voltage regulator in the form of a localized positive feedback loop to enhance transient capabilities.

With reference additionally now to FIG. 5A, this topology is illustrated in more general terms wherein only a single PMOS transistor 45 ("MP1") and a current mirror 47 are utilized. As previously described, the size of transistor 45 is much smaller than the output power PMOS transistor 20. When the LDO voltage regulator is unloaded, (i.e. at zero output current), the power PMOS output transistor 20 only sources the quiescent current flowing through the feedback resistors 24 and 26. This gate voltage is sensed by transistor 45 which, in turn, attempts to deliver a ratio of the current to the current mirror 47. However, due to the provision of a relatively high mirror ratio, the current sourced by transistor 45 is negligible and it consumes no power. If the output at node 32 is suddenly fully loaded, the error amplifier 16 (FIG. 3) through the buffer 42 tries to discharge the highly capacitive node 44 with limited current. At this point, transistor 45 starts to conduct and, through the localized positive feedback loop, aids the error amplifier 16 in sinking more current. As a practical matter, the gain of the loop is small, and the stability of the overall system is not affected by it. Among the benefits of the transient boost circuit 40 disclosed is that it requires a minimum of on-chip die area and it is simple and power efficient, that is, it only sinks current upon demand.

With reference additionally now to FIG. 5B, an alternative transient boost circuit 40[1] in accordance with the present invention is shown. In this case, a substantially unity (A=1) gain buffer 46 couples node 44 to node 22 and two normally "off" switching devices comprising series connected N-channel transistor 48 and P-channel transistor 50 are added which couple node 22 to the $V_{in}$ and circuit ground voltage supply sources respectively. The transistors 48, 50 are only turned "on" when the error amplifier 16 (FIG. 3) is slewing enough to yield a voltage difference across the unity gain buffer 46 large enough to turn on either of the transistors 48, 50.

It should be noted that enhanced performance of the transient boost circuit 40[1] may be achieved if the threshold voltage of the transistors 48, 50 were made lower, that is, on the order of 0.4–0.5 volts. This can be achieved by slightly forward biasing the bulk to source voltage. See, for example, P. E. Allen, B. J. Blalock and G. A. Rincon, "A 1V CMOS Op Amp Using Bulk-Driven MOSFETs", IEEE International Solid-State Circuits Conference Digest, pp. 192–193, February 1995 (the disclosure of which is herein specifically incorporated herein by this reference) as dictated by the threshold voltage ($V_{th}$) equation:

$$V_{th} = V_{to} + \gamma\left[\sqrt{2|\phi_f| - V_{bs}} - \sqrt{2|\phi_f|}\right] \quad \text{Equation 5}$$

where $V_{to}$ is $V_{th}$ at $V_{bs}$=0, γ is the body bias coefficient, and /φf/ is the bulk Fermi potential. In the embodiment illustrated, forward biasing the bulk to source voltage ("$V_{BS}$") would enhance the performance of the circuit by reducing the threshold voltage of the transistors 48 and 50 such that $V_{BS}>0$ for transistor 48 and $V_{BS}<0$ for transistor 50 as per the foregoing equation 5.

With reference additionally now to FIG. 5C, an alternative embodiment of a transient boost circuit 40[2] is shown which utilizes still another method for adjusting the threshold voltage of the transistors 48, 50 through the use of a double gate input device incorporating capacitors 52 ("C1") and 54 ("C2"). See, for example, T. Shibata and T. Ohmi, "A functional MOS Transistor Featuring Gate-Level Weighted Sum and Threshold Operations", IEEE Transactions on Electron Devices, Vol. 39, No. 6, pp. 1444–1455, June 1992, the disclosure of which is herein specifically incorporated by this reference. The voltage at the gate of the transistors is dictated by the following equation:

$$V_{gate}=(V1C1/C_{total})+(V2C2/C_{total}) \quad \text{Equation 6}$$

$$\text{Thus, } V_{th1}=((V_{th}C_{total})/C1)-(V2C2/C1) \quad \text{Equation 7}$$

where $V_{gate}$ is the potential at the floating gate, $C_{total}$ is $C_1+C_2+C_g$, Cg is the gate capacitance to the bulk of transistor 48, $V_{th1}$ is the effective threshold voltage of terminal 1, and $V_{th}$ is the threshold voltage seen at the floating gate. Hence, proper capacitor ratios can yield lower effective threshold voltages (i.e. 0.49 volts where $C_1=C_2=8C_g$, $V_2$=1 volt and $V_{th}$=0.7 volts). In an integrated circuit embodiment of the present invention, physical realization of the capacitors can be had through the use of a second polysilicon or metal layer on top of a first polysilicon gate layer connected to the active gate of the transistor.

The typical transient response for an LDO voltage regulator incorporating a transient boost circuit in accordance with the present invention is illustrated (trace "a") in FIG. 6 in comparison with a circuit not incorporated a transient boost circuit (trace "b") under similarly biased conditions. The maximum output voltage change is determined by the following relation:

$$V_{o\text{-}max\text{-}change}\approx ILoad\Delta T/(C_o+C_b) \quad \text{Equation 8}$$

where ΔT is the time the circuit requires to turn on the output PMOS transistor 20. In the case of a typical LDO voltage regulator without a transient boost circuit (such as 40, 40[1] or 40[2]), the time is dominated by the slew-rate limit at the gate of the large output PMOS transistor 20 ($\Delta T=C_{gs}\Delta V_{sg}/I_{bias}\approx 100p(0.5)/1\mu\approx 50$ μsec. which translates to $V_{o\text{-}max\text{-}change}\approx 530$ mV). For the case illustrated in FIG. 3, the following relation applies:

$$\Delta T=T_{amp}+T_{PMOSsense\text{-}on}+T_{latch\text{-}up}+T_{PMOS\text{-}out}\approx({}^{1}/BW_{CL})+TP_{MOSsense\text{-}on}+T_{latch\text{-}up} \quad \text{Equation 9}$$

where $T_{amp}$ is the time required for the OTA to respond, $T_{PMOSsense\text{-}on}$ is the time required for the sensing PMOS transistor 20 in the transient boost circuit 40 to turn on, $BW_{CL}$ is the closed loop bandwidth of the system and $T_{latch\text{-}up}$ is the time required for the positive feedback circuit to latch up. The circuit will attempt to latch up until the slewing condition is terminated and the error amplifier 16 (FIG. 3) functions linearly. The overall time is mostly dominated by the time that is required for the sensing PMOS 22 to go from essentially zero to sub-threshold and finally to strong inversion. This time can be on the order of 1 to 8 μseconds which is lower than in the case of a similarly biased embodiment without a transient boost circuit (50 μs) thereby achieving a factor improvement of 6 to 10.

While there have been described above the principles of the present invention in conjunction with specific circuitry and integrated circuit processing technology, it is to be clearly understood that the foregoing description is made only by way of example and not as a limitation to the scope of the invention. Without limitation, it is recognized that the exemplary LDO voltage regulator disclosed herein may comprise the functional structure of any conventional LDO voltage regulator regardless of whether manufactured utilizing PMOS, NMOS, CMOS, BiCMOS, bipolar or any other semiconductor processing and design technology. Moreover, the principles of the present invention are likewise applicable to any LDO voltage regulator utilizing PMOS, NMOS, bipolar or other output transistors or switching devices.

Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicants hereby reserve the right to formulate new claims to such features and/or combinations of such features during the prosecution of the present application or of any further application derived therefrom.

What is claimed is:

1. A low-dropout voltage regulator comprising:

an error amplifier having first and second inputs and a reference output thereof, said first input for receiving an output of a bandgap circuit;

an output switching device having first and second terminals and a control input thereof, said first terminal thereof being coupled to a first supply voltage input and said control input being coupled to receive a reference signal from said reference output of said error amplifier;

first and second series coupled resistors coupling said second terminal of said output switching device to a second supply voltage input, said second terminal of said output switching device being coupled to provide a voltage output of said LDO voltage regulator and a node intermediate said first and second resistors being coupled to said second input of said error amplifier; and a transient boost circuit coupling said reference output of said error amplifier to said control input of said output switching device, said transient boost circuit operative to supply a transient current to said control terminal of said output switching device in response to a transient increase in the current load placed on said voltage output of said LDO voltage regulator.

2. The LDO voltage regulator of claim 1 further comprising a buffer circuit interposed between said reference output of said error amplifier and said output switching device.

3. The LDO voltage regulator of claim 1 wherein said transient boost circuit comprises a localized positive feedback loop.

4. The LDO voltage regulator of claim 3 wherein said localized positive feedback loop comprises a switching device coupled to said first supply voltage input for operatively controlling a current mirror.

5. The LDO voltage regulator of claim 1 wherein said transient boost circuit comprises first and second series coupled switching devices coupling said first and second supply voltage inputs to said control terminal of said output switching device, said first and second series coupled switching devices having a respective control terminal thereof coupled to said reference output of said error amplifier and operative to supply current to said control terminal of said output switching device upon slew-rate conditions thereof.

6. The LDO voltage regulator of claim 5 wherein said first and second series coupled switching devices comprise field effect transistors having their bulk tied to a bias voltage to reduce their respective threshold voltages.

7. The LDO voltage regulator of claim 5 further comprising a substantially unity gain buffer amplifier coupling said reference output of said error amplifier to said control terminal of said output switching device.

8. The LDO voltage regulator of claim 5 further comprising first and second capacitive element pairs coupling said control terminal of each of said first and second series coupled switching devices to said reference output of said error amplifier and to an associated bias voltage source.

9. A transient boost circuit for an LDO voltage regulator, said LDO voltage regulator incorporating a bandgap circuit for providing a reference input to an error amplifier, said error amplifier having an error output thereof coupled to a control terminal of an output switching device, said output switching device having a first terminal thereof coupled to a first voltage source and a second terminal thereof coupled to a series coupled resistor pair coupled to a second voltage source, said series coupled resistor pair having an intermediate node coupled to a feedback input of said error amplifier, said transient boost circuit comprising:

a transistor having drain source and gate terminals thereof, said transistor having said drain terminal thereof coupled to said first voltage source and said gate terminal thereof coupled to said control terminal of said output switching device;

a current mirror coupling said source terminal of said transistor to said second voltage source and having an output terminal coupled to the control terminal of said output switching device.

10. The transient boost circuit of claim 9 wherein said output switching device comprises a MOSFET.

11. The transient boost circuit of claim 10 wherein said MOSFET comprises a PMOS device.

12. The transient boost circuit of claim 9 wherein said transistor comprises a MOSFET.

13. The transient boost circuit of claim 12 wherein said MOSFET comprises a PMOS device.

14. The transient boost circuit of claim 9 further comprising a buffer interposed between said error output of said error amplifier and said control terminal of said output switching device.

15. The transient boost circuit of claim 14 wherein said buffer comprises an additional transistor.

16. The transient boost circuit of claim 15 wherein said additional transistor comprises a bipolar transistor.

17. The transient boost circuit of claim 16 wherein said bipolar transistor comprises an NPN transistor.

18. A transient boost circuit for an LDO voltage regulator, said LDO voltage regulator incorporating a bandgap circuit for providing a reference input to an error amplifier, said error amplifier having an error output thereof coupled to a control terminal of an output switching device, said output switching device having a first terminal thereof coupled to a first voltage source and a second terminal thereof coupled to a series coupled resistor pair coupled to a second voltage source, said series coupled resistor pair having an intermediate node coupled to a feedback input of said error amplifier, said transient boost circuit comprising:

first and second series connected transistors having respective source, drain and gate terminals thereof, said first and second transistors having said source terminals thereof coupled to said first and second voltage sources respectively and said drain terminals thereof coupled to said control terminal of said output switching device, said first and second transistors having said gate terminals coupled to said error output of said error amplifier; and a buffer amplifier coupling said error output of said error amplifier to said control terminal of said output switching device.

19. The transient boost circuit of claim 18 wherein said first and second series connected transistors comprise MOSFETs.

20. The transient boost circuit of claim 19 wherein said first and second series connected transistors have their bulk tied to a bias voltage to reduce their respective threshold voltages.

21. The transient boost circuit of claim 19 wherein said first transistor comprises an N-channel MOSFET and said second transistor comprises a P-channel MOSFET.

22. The transient boost circuit of claim 18 further comprising first and second capacitor pairs associated with said first and second series connected transistors respectively, first ones of said first and second capacitor pairs being disposed between said gate terminals of said first and second series connected transistors and said error output of said error amplifier and second ones of said first and second capacitor pairs coupling said gate terminals of said first and second series connected transistors to respective bias voltage sources.

23. The transient boost circuit of claim 18 wherein said buffer amplifier has a gain of substantially one.

24. The transient boost circuit of claim 18 further comprising a buffer interposed between said error output of said error amplifier and said control terminal of said output switching device.

25. The transient boost circuit of claim 18 wherein said buffer comprises an additional transistor.

26. The transient boost circuit of claim 25 wherein said additional transistor comprises a bipolar transistor.

27. The transient boost circuit of claim 26 wherein said bipolar transistor comprises an NPN transistor.

28. A method for providing transient boost current to a control terminal of an output switching device of an LDO voltage regulator comprising the steps of:

establishing a current flow through said output switching device; and supplying a ratio of said current flow through said output switching device as said transient boost current to said control terminal of said output switching device when said current flow is transiently increased.

29. The method of claim 28 wherein said step of establishing a current flow through said output switching device further comprises the steps of:

providing an additional switching device; and enabling said additional switching device in conjunction with said step of establishing said current flow through said output switching device.

30. The method of claim 29 wherein said step of supplying a ratio of said current flow through said output switching device is carried out by the steps of:

providing a current mirror; and enabling said current mirror in response to said step of enabling said additional switching device.

31. The method of claim 28 wherein said step of establishing a current flow through said output switching device further comprises the steps of:

providing first and second series connected switching devices; and enabling said first and second series connected switching devices in conjunction with said step of establishing said current flow through said output switching device.

32. The method of claim 31 wherein said step of supplying a ratio of said current flow through said output switching device is carried out by the steps of:

coupling said first and second series connected switching devices between first and second supply voltage sources; and supplying current to said control terminal of said output switching device in response to said step of enabling said first and second series connected switching devices.

* * * * *